United States Patent [19]

Akkerman et al.

[11] Patent Number: 4,726,421

[45] Date of Patent: Feb. 23, 1988

[54] LATCHING DEVICES

[75] Inventors: Neil H. Akkerman, Houston; John P. Hare, Pearland, both of Tex.

[73] Assignee: AVA International Corporation, Houston, Tex.

[21] Appl. No.: 26,830

[22] Filed: Mar. 17, 1987

[51] Int. Cl.[4] ..... E21B 23/03

[52] U.S. Cl. ..... 166/117.5; 166/217; 166/237

[58] Field of Search ..... 166/117.5, 214, 217, 166/125, 237, 115; 294/86.18, 86.25, 86.17

[56] References Cited

U.S. PATENT DOCUMENTS

| | | | |
|---|---|---|---|
| 2,392,244 | 1/1946 | Hooser | 166/125 |
| 2,962,097 | 11/1960 | Dollison | 166/217 X |
| 3,074,485 | 1/1963 | McGowen, Jr. | 166/217 |
| 3,086,593 | 4/1963 | Chitwood | 166/224 |
| 3,102,594 | 9/1963 | Crowe | 166/214 X |
| 3,136,366 | 6/1964 | Brown et al. | 166/125 X |
| 3,638,988 | 2/1972 | Brown | 294/86.18 |
| 3,741,601 | 6/1973 | Dudley | 294/86.18 |

*Primary Examiner*—James A. Leppink
*Assistant Examiner*—Hoang C. Dang
*Attorney, Agent, or Firm*—Vaden, Eickenroht, Thompson & Boulware

[57] ABSTRACT

There is disclosed a device for latching a well tool within the seal bore of a pocket to one side of a bore through a mandrel connectable in the well string. The mandrel has a recess above the seal bore to receive latching dogs on the lower end of collet fingers carried by the device and an upwardly facing shoulder above the recess which engages the latching dogs to cause them to be flexed inwardly as they are lowered into positions opposite the recess.

1 Claim, 6 Drawing Figures

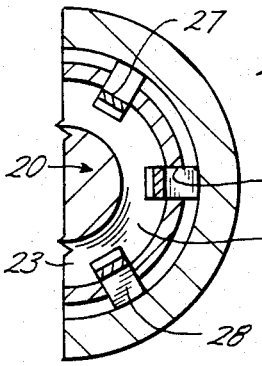
Fig. 4
Fig. 5
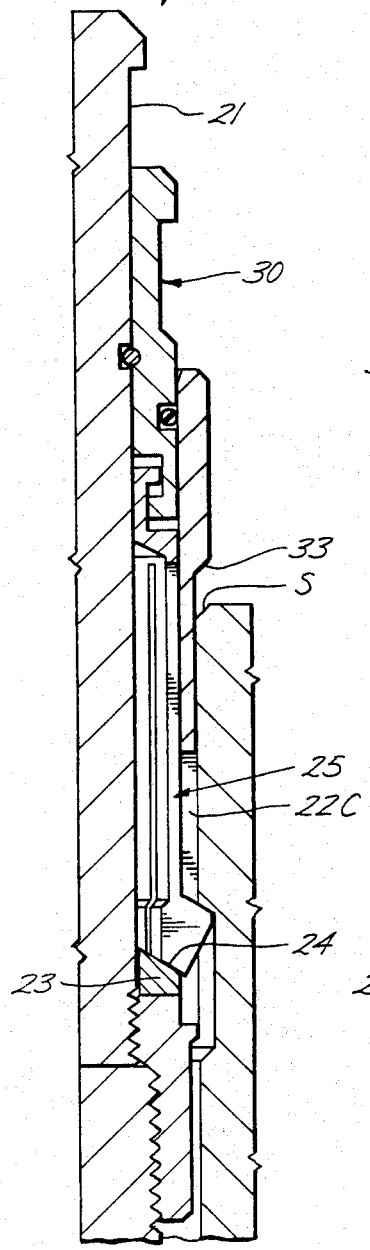
Fig. 6
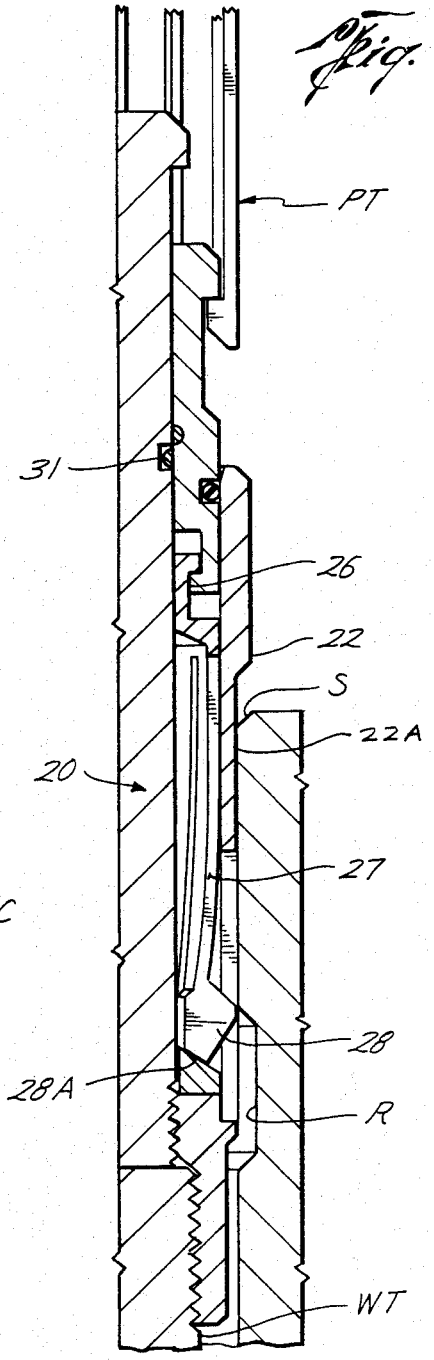

LATCHING DEVICES

This invention relates in general to devices for latching well tools within the seal bore of a pocket to one side of the bore through a mandrel connectable in the well string. More particularly, it relates to devices of this type which includes a collet having latching dogs on the lower ends of flexible fingers which are adapted to be received in a recess of the mandrel about its seal bore and below an upwardly facing shoulder which is engaged by the latching dogs, the fingers to be flexed inwardly in order to permit the latching dogs to be lowered into positions opposite the recess.

A device of this type which is shown and described in U.S. Pat. No. 3,741,601, includes a central body from which the well tool may be suspended and having a neck to which a wireline tool may be connected for lowering the tool into the pocket. A sleeve surrounds the body above an upwardly facing shoulder thereon, and one or more shear pins releasably connect the body and sleeve with the lower end of the sleeve adjacent the shoulder. A collet having a ring at its upper end is vertically slidable over an enlarged diameter portion of the sleeve to dispose latching dogs at the lower ends of flexible fingers depending from the ring opposite a recess about the sleeve, when the collet is in an upper position, and opposite an enlargement about the lower end of the sleeve, when the collet is in a lower position seated upon the shoulder.

The dogs having radially outer enlargements which engage the mandrel shoulder, as the well tool is lowered in the pocket, to force the sleeve to its upper position and thus cause the fingers to flex inwardly and the dogs to move into the sleeve recess until they are opposite the mandrel recess, and then flex outwardly to move the dogs into the recess, as the well tool is lowered into the pocket. The body has a "no go" shoulder thereabout which engages a shoulder on the mandrel to land the tool with the dogs in the recess, following which the body may be raised to cause the enlargements on the dogs to engage the upper end of the mandrel recess and the sleeve enlargement to be raised into the collet dogs to thereby latch the well tool in the pocket.

The sleeve also has a fishing neck thereabout so that, upon removal of the running tool from the neck of the central body of the tool, a wireline pulling tool may be lowered over the neck of the sleeve to impart an upward jar thereto which shears the pins connecting the sleeve to the body. The sleeve has a lost motion connection to the body which, upon raising of the enlargement on its lower end above the collet dogs to permit the dogs to move inwardly beneath the enlargement, lifts the body with the sleeve as the sleeve is raised further to remove the collet dogs from within the mandrel recess and thereby retrieve the well tool.

The need to shift the body and sleeve between latching and releasing positions requires substantial vertical movement, and thus a substantially long seal bore in the pocket, which in turn adds to the expense of manufacturing the mandrel. It is therefore the principal object of this invention to provide a device of this type which requires less vertical movement as it is raised and lowered between latching and unlatching position.

These and other objects are accomplished, in accordance with the illustrated embodiment of the invention, by a device of the type described in which the central body has means thereon providing an upwardly facing, downwardly and outwardly conically shaped seating surface, and a collet surrounding the body above the seating surface and including a ring at its upper end vertically slidable along the body, fingers depending therefrom in spaced relation to the body, and latching dogs on the lower ends of the fingers having conically shaped surfaces for sliding over the seating surface. As in the case of the prior device of U.S. Pat. No. 3,741,601, the latching dogs have radially outer enlargements which engage the shoulder on the mandrel, as the well tool is lowered into the pocket, to cause the fingers to flex inwardly until the dogs are opposite the recess, and then flex outwardly to move the dogs into the recess, and the enlargements having conically shaped surfaces at their upper ends for moving outwardly into the mandrel recess for engaging the conically shaped upper end thereof to latch the device in place.

A sleeve surrounds the body above the collet and has a lost motion connection with the collet which permits limited vertical movement between them, and the sleeve and body are releasably connected so as to suspend the collet from the body in a position to permit it to be moved upwardly with respect to the body as the collet dogs are lowered into a position opposite the recess, and then move downwardly with respect thereto as the dogs move into the recess below its upper end. More particularly, the body has a shoulder thereon which is engageable with the mandrel shoulder to land the well tool in the pocket following movement of the dogs in the recess.

The conically shaped surfaces on the latching dogs are parallel to one another and to the seating surface and the upper end of the recess, and the angle between these and the vertical axes of the seal bore of the side pocket and the well tool in the pocket is so related to the "friction angle" between them as to prevent removal of the dogs from the recess due to upwardly directed forces in the body. Thus, it is possible to latch the device to the mandrel without external enlargements over which the latching dogs on the collet must be moved as they are moved between latching and releasing positions, thereby permitting the device to be shorter than the previously described device. Moreover, the sleeve has means thereon to which a wireline tool may be connected for jarring the sleeve in order to release its connection to the body and then lift the sleeve therewith to pull the dogs from within the recess in order to retrieve the well tool from the side pocket.

In the drawings, wherein like reference characters are used throughout to designate like parts:

FIG. 4 is a cross-sectional view of the device, as seen along broken lines 4—4 of FIG. 3;

Figure 3:
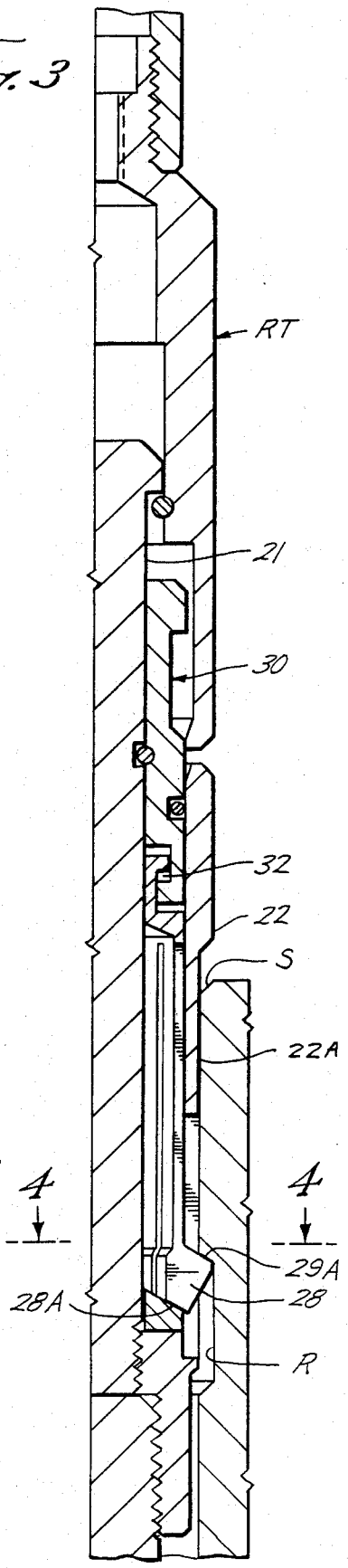
FIG. 3 is a view similar to FIG. 2, wherein the device has been further lowered to a position in which the latching dogs have been moved outwardly into the recess and then lifted to move conically shaped surfaces thereon into engagement with the upper end of the mandrel recess.

FIG. 5 is a vertical sectional view of the device, similar to that of FIG. 3, but following removal of the running tool therefrom; and FIG. 6 is another view, similar to FIG. 5, but upon lowering of a pulling tool into engagement about a fishing neck on the upper end of the sleeve of the device, and raising of same to shear the connection between the sleeve and central body of the device and then lift the collet with the sleeve and thus move the latching dogs out from beneath the upper end of the mandrel recess in order to permit retrieval of the device.

Figure 1:
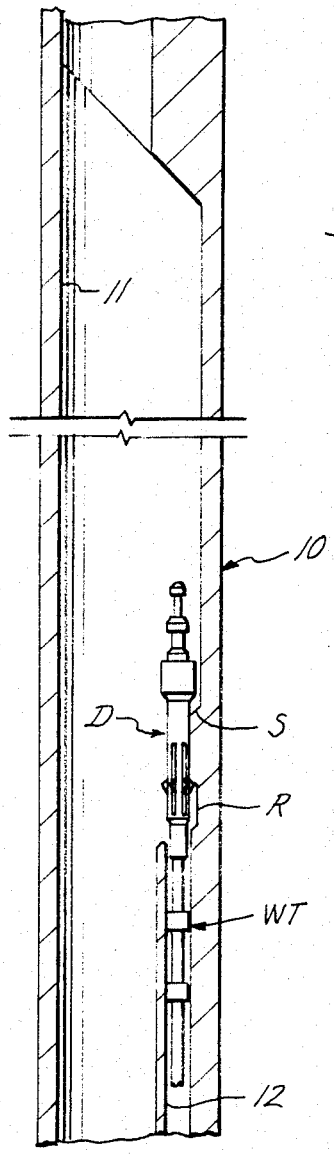
FIG. 1 is a vertical sectional view of a mandrel, interrupted along its length, and having a side pocket with a seal bore into which a well tool has been lowered by means of a device constructed in accordance with the present invention.

With reference now to the details of the above-described drawings, the mandrel, which is indicated in its entirety by reference character 10, is shown in FIG. 1 to have a main bore 11 therethrough which, upon connection of the mandrel in a well string, forms a continuation of the well string with which the mandrel is connected. The bore is enlarged intermediate its upper and lower ends to provide top entry to a side pocket 12 formed therein to one side of the main bore to receive a well tool WT adapted to be lowered into or removed from the side pocket by means of a device D constructed in accordance with the present invention. As well known in the art, the side pocket has a seal bore therein to receive packing about the well tool WT when the latter is landed in the pocket coaxially of the side pocket.

As previously described, a mandrel 10 of the type contemplated by the present invention also has a recess R in its bore above the seal bore of the pocket, and an upwardly facing shoulder S above the recess. The device D is best shown in the remaining Figures of the drawings to include a central body 20 having a lower end to which the well tool is connected for suspension therefrom, and an upper end which includes a neck 21 to which a running tool RT may be releasably connected for use in lowering the device and thus the well tool suspended therefrom into the side pocket. As shown, the fishing neck has a flange about its upper end, and the running tool has a shear pin which is disposed beneath the shoulder to support the central body for lowering therewith, but which is shearable upon upward jarring of the running tool to permit removal of the running tool following landing of the well tool.

An outer body 22 surrounding the central body 20 includes an upper end 22A which is spaced therefrom, a reduced diameter lower end 22B fitting closely about the body and seated upon an upwardly facing shoulder about the lower end of the central body, and windows 22C intermediate its upper and lower ends. A ring 23 supported on the shoulder on the lower end of the outer body provides an upwardly facing, conically shaped, downwardly and outwardly extending seating surface 24 adjacent the lower ends of the windows, and a collet 25 is disposed about the central body within the space between the central and outer bodies. The collet includes a ring 26 at its upper end vertically slidable within the space, and flexible fingers 27 depending therefrom outwardly of the central body and slidable within the outer body to support latching dogs 28 on their lower ends opposite the windows 22C and above the seating surface 24. More particularly, the latching dogs have conically shaped lower surfaces 28A on their lower ends for sliding over surface 24, and outward enlargements 29 which are adapted to engage shoulder S, and which have conically shaped surfaces 29A adapted to face upper end of recess R in order to latch the well tool in the pocket.

Figure 2:
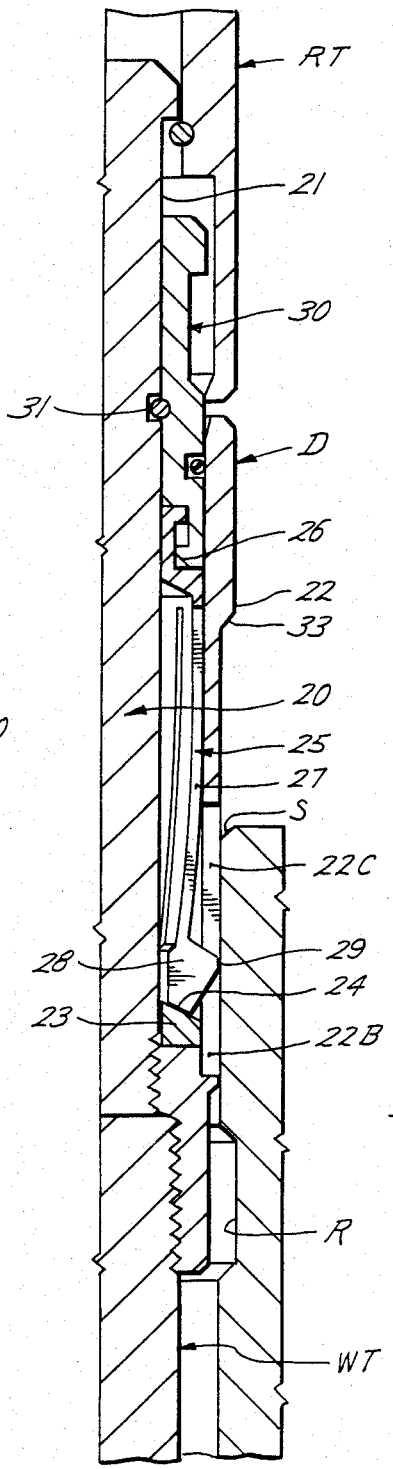
FIG. 2 is an enlarged partial vertical sectional view of the device as it is being lowered to install the well tool in the seal bore of the pocket, and showing the flexing of the collet fingers inwardly to positions to permit the latching dogs on their lower ends to be moved past the upwardly facing shoulder on the mandrel and into the recess above the seal bore.

The collet is releasably supported from the lower end of a sleeve 30 within the space between the central body and outer body, which is in turn releasably connected in a fixed vertical position with respect to the central body 20 by means of a shear ring 31. The lower end of the sleeve and the ring 26 of the collet have inwardly and outwardly extending flanges which form a lost motion connection which enables relative vertical movement between them. Thus, as the device is lowered to cause the enlargements 29 on the locking dogs to engage the shoulder S, the collet is forced upwardly to the position shown in FIG. 2 to raise the lower ends of the latching dogs above the seating surface 24, which permits the latching dogs to move radially inwardly to positions in which they are free to move downwardly past the shoulder S and into a position opposite the recess in the mandrel, as shown in FIG. 3.

As the latching dogs move into a position opposite the recess R, the fingers 27 flex outwardly to force the locking dogs into the recess and thus the surfaces 29A beneath the upper end of recess R. Then, upon raising of the central body, the sleeve 30 is also raised with respect to the collet so as to bring the seating surface 24 into engagement with the lower ends of the latching dogs, and thus force surfaces 29A into engagement with the conically shaped upper end of the recess R.

As previously described, the conically shaped surfaces 28A and 29A on the latching dogs are parallel to one another and to the seating surface 24 and the downwardly and outwardly extending, conically shaped upper end of the recess, and extend at an angle with respect to the vertical axes of the device and the well tool landed in the seal bore which is less than the friction angle between them. As a result, when the device is latched to the mandrel, upward forces exerted on the latching dogs through lifting of the central body of the device, either by raising of the running tool RT or in response to upward pressure acting across the well tool WT, will not release the latching within the recess.

Following latching of the device within the mandrel, and as shown in FIG. 5, the running tool RT may be removed therefrom by an upward jar sufficient to shear the pin which suspends the fishing neck of the central body of the device from the running tool. Thus, as previously noted, as long as the interengaging surfaces between the latching dogs, recess, and the seating surface on the central body of the device are of the proper angle, neither this upward jar necessary to shear the pin or other upwardly directed forces on the central body will release the device from its latch position.

Even though the device may move downwardly from the latching position shown in FIG. 3, such downward movement is limited by engagement of a "no-go" shoulder 33 about the upper end of the outer body with the shoulder S of the mandrel land the well tool in the pocket without forcing the latching dogs inwardly by their engagement with the lower end of the recess.

In order to release the device from its latching within the mandrel, and thus permit retrieval of the well tool, pulling tool PT is lowered into a position in which collet fingers about its lower end are engaged beneath a fishing neck on the upper end of the sleeve, as shown in FIG. 6. When the pulling tool is so engaged with the sleeve, it may be jarred upwardly to shear pin 31 releasably connecting the sleeve to the running tool. This in turn permits the sleeve to be raised to its upper position with respect to the running tool, as shown in FIG. 6, and thereby permit the collet to be raised with the sleeve, as also shown in FIG. 6, in order to pull the latching dogs from within the recess, and thus permit retrieval of the device.

From the foregoing it will be seen that this invention is one well adapted to attain all of the ends and objects hereinabove set forth, together with other advantages which are obvious and which are inherent to the apparatus and structure.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. A device for use in latching a well tool within a seal bore of a pocket to one side of a bore of a mandrel connectable in a well string, wherein the mandrel has a latching recess above the seal bore and the recess has an upwardly and inwardly tapered conically shaped upper end and an upwardly facing shoulder above the recess, said device comprising a central body from which the well tool may be suspended and having means to which a wireline tool may be releasably connected for lowering the well tool therewith into the pocket, means providing an upwardly facing, downwardly and outwardly extending conically shaped seating surface about the body, a collet surrounding the body above the seating surface and including a ring at its upper end vertically slidable along the body, fingers depending from the ring in spaced relation to the body, and latching dogs on the lower ends of the fingers having conically shaped surfaces which are slidable over the seating surface, said latching dogs having radially outer enlargements which engage the shoulder on the mandrel, as the well tool is lowered into the pocket, to cause the fingers to flex inwardly to permit the dogs to move opposite the recess, and then flex outwardly to move the dogs into the recess, said enlargements having conically shaped surfaces on their upper ends which are engageable with the upper end of the recess, a sleeve surrounding the body above the collet and having a lost motion connection with the collet ring which permits limited vertical movement between them, and means releasably connecting the sleeve to the body so as to suspend the collet therefrom in a position to permit it to be moved upwardly with respect to the central body as the collet dogs are lowered into position opposite the recess, and then move downwardly with respect thereto upon movement into the recess, said body having a shoulder thereon engageable with the mandrel shoulder to land the well tool in the pocket following movement of the dogs into the recess, the conical surfaces on the latching dogs being parallel to one another and to the seating surface on the central body and the upper end of the recess, when the well tool is landed in the pocket, the angle between said parallel surfaces and the axis of the seal bore of the side pocket preventing removal of the dogs from the recess due to upwardly directed forces on the body, and said sleeve having means thereon to which a wireline tool may be connected for jarring said sleeve in order to release its connection to the body and then lift said sleeve therewith to pull the dogs from within the recess in order to retrieve the well tool from the side pocket.

* * * * *